US010792665B2

(12) United States Patent
Simons et al.

(10) Patent No.: US 10,792,665 B2
(45) Date of Patent: Oct. 6, 2020

(54) AGITATOR BALL MILL

(71) Applicant: Willy A. Bachofen AG, Muttenz (CH)

(72) Inventors: Benedikt Simons, Schopfheim (DE); Lionel Gross, Rouffach (FR); Norbert Stehr, Grünstadt (DE)

(73) Assignee: Willy A. Bachofen AG, Muttenz (CH)

( * ) Notice: Subject to any disclaimer, the term of this patent is extended or adjusted under 35 U.S.C. 154(b) by 363 days.

(21) Appl. No.: 15/783,431

(22) Filed: Oct. 13, 2017

(65) Prior Publication Data

US 2018/0104699 A1 Apr. 19, 2018

(30) Foreign Application Priority Data

Oct. 18, 2016 (EP) ..... 16194369

(51) Int. Cl.
*B02C 17/20* (2006.01)
*B02C 17/16* (2006.01)
*B02C 17/18* (2006.01)

(52) U.S. Cl.
CPC ..... *B02C 17/163* (2013.01); *B02C 17/161* (2013.01); *B02C 17/166* (2013.01); *B02C 17/184* (2013.01); *B02C 17/20* (2013.01); *B02C 2017/165* (2013.01)

(58) Field of Classification Search
CPC ... B02C 17/163; B02C 17/166; B02C 17/161; B02C 17/20; B02C 17/205; B02C 17/184; B02C 17/16; B02C 17/185; B02C 2017/165
USPC ..... 241/171
See application file for complete search history.

(56) References Cited

U.S. PATENT DOCUMENTS 3,550,915 A * 12/1970 Vladislav ..... B02C 17/163 366/317
4,824,033 A 4/1989 Buehler
5,333,804 A * 8/1994 Liebert ..... B02C 17/16 241/172
5,544,825 A * 8/1996 Stehr ..... B02C 17/16 241/171
5,566,896 A * 10/1996 Stehr ..... B02C 17/16 241/171

(Continued)

FOREIGN PATENT DOCUMENTS

AU 2015353141 B2 8/2018
CH 700446 A1 8/2010

(Continued)

*Primary Examiner* — Shelley M Self
*Assistant Examiner* — Smith Oberto Bapthelus
(74) *Attorney, Agent, or Firm* — Merchant & Gould P.C.

(57) ABSTRACT

An agitator ball mill comprises agitating discs (18) on an agitating shaft, wherein two adjacent agitating discs (18) are bounding a grinding cell, respectively. The agitating discs (18) comprise grinding material passage openings (28) which are only arranged in the immediate proximity of a grinding chamber inner boundary (19), which connect adjacent grinding cells, and which have a radially outer boundary that has a distance R28 starting from the grinding chamber inner boundary (19) in the radial direction of the agitating disc (18). For the ratio of the distance R28 of the radially outer boundaries of the grinding material passage openings (28) to a radial extension R18 of the agitating discs (18), the following condition applies: $0.05 \cdot R18 \leq R28 \leq 0.25 \cdot R18$. Otherwise the agitating discs (18) are closed.

14 Claims, 6 Drawing Sheets

(56) References Cited

U.S. PATENT DOCUMENTS

Figure 1:
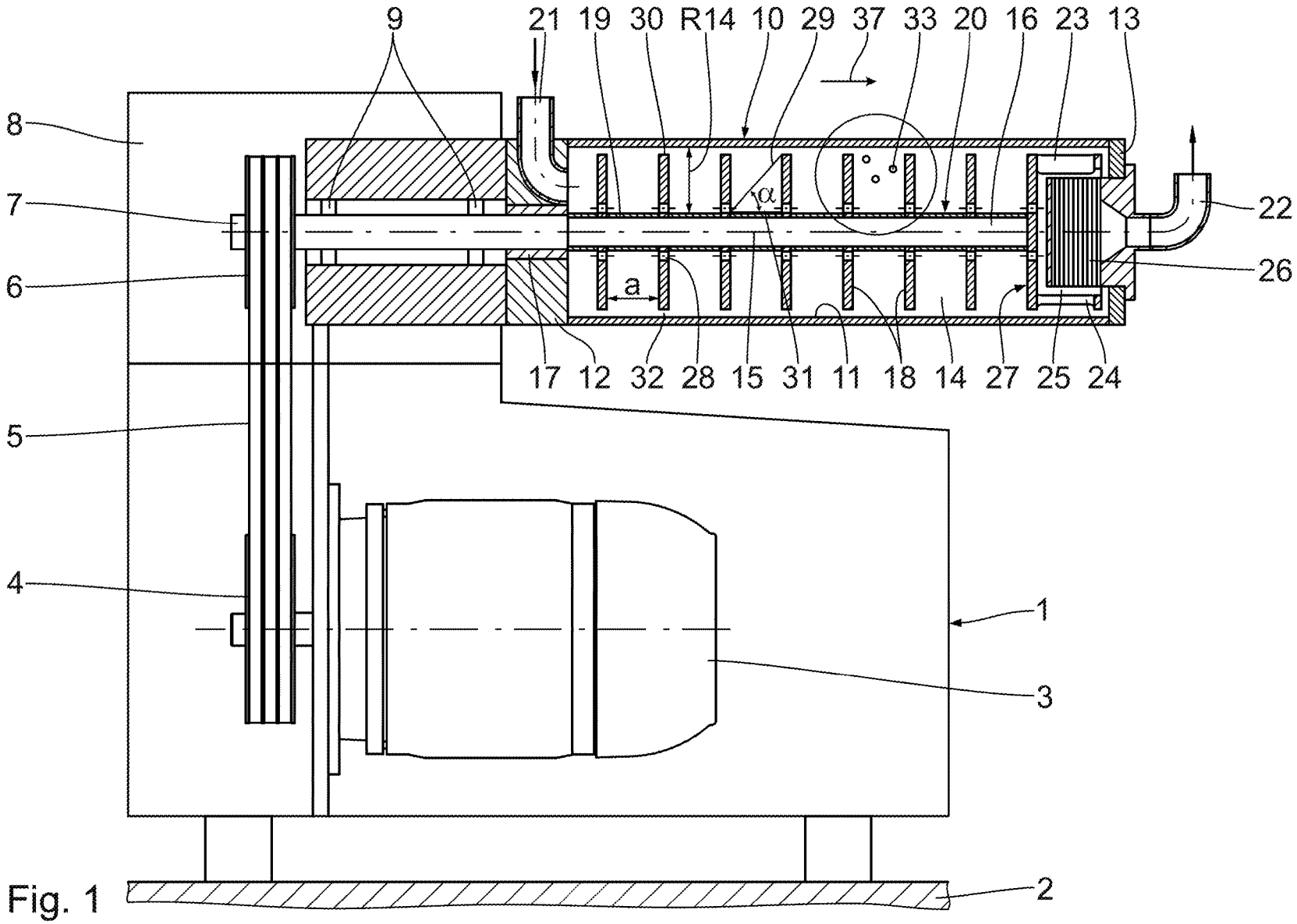

| | | | | |
|---|---|---|---|---|
| 6,808,136 | B2 * | 10/2004 | Sneeringer | B01F 7/00466 241/172 |
| 7,014,134 | B2 * | 3/2006 | Heinzelmann | B02C 17/161 241/171 |
| 8,118,247 | B2 * | 2/2012 | Lang | B02C 17/16 241/171 |
| 2010/0127108 | A1 | 5/2010 | Harbs | |
| 2011/0036935 | A1 * | 2/2011 | Stehr | B02C 17/161 241/69 |
| 2011/0303774 | A1 * | 12/2011 | Jeker | B02C 17/163 241/30 |
| 2014/0041746 | A1 * | 2/2014 | Hug | B02C 17/16 138/149 |
| 2016/0107163 | A1 * | 4/2016 | Pausch | B02C 17/161 241/30 |
| 2017/0014830 | A1 | 1/2017 | Simons et al. | |

FOREIGN PATENT DOCUMENTS

| | | | | |
|---|---|---|---|---|
| CN | 101808746 | A | 8/2010 | |
| CN | 202570278 | U | 12/2012 | |
| CN | 203235524 | U | 10/2013 | |
| CN | 203304024 | U | 11/2013 | |
| CN | 204170782 | U | 2/2015 | |
| CN | 205323895 | U | 6/2016 | |
| DE | 1632424 | A1 | 8/1970 | |
| DE | 4142213 | A1 * | 6/1993 | B02C 17/161 |
| DE | 102013111762 | A1 | 1/2015 | |
| EP | 0751830 | A1 | 1/1997 | |
| EP | 2178642 | A1 | 4/2010 | |
| EP | 2189221 | A2 | 5/2010 | |
| EP | 2905080 | A1 | 8/2015 | |
| EP | 3050628 | A1 | 8/2016 | |
| GB | 1197523 | A | 7/1970 | |
| WO | 2009/024158 | A1 | 2/2009 | |
| WO | 2013/118957 | A1 | 8/2013 | |
| WO | 2016/082812 | A1 | 6/2016 | |

* cited by examiner

AGITATOR BALL MILL

This application claims benefit of Ser. No. 16/194,369.1, filed on 18 Oct. 2016 in the European Patent Office and which application is incorporated herein by reference. To the extent appropriate, a claim of priority is made to the above disclosed application.

The invention relates to an agitator ball mill having a horizontally arranged grinding vessel and an agitator.

Such an agitator ball mill is known from EP 2 178 642 A1. In such agitator ball mills, a flowable grinding material, a grinding material suspension is ground or dispersed with the aid of grinding bodies. The grinding suspension consists of a carrier liquid and solids distributed therein, wherein the starting particle size is in the range of some micrometers to some hundreds of micrometers. The final size is in the range of micrometers, submicrons, and in special cases even nanometers.

In the agitator ball mill known from EP 2 178 642 A1 there are relatively large openings formed in the agitating discs that are bounding adjacent grinding cells, which are arranged some distance away from the inner wall of the grinding chamber. The grinding bodies are accelerated outwardly by the agitating disc at the surface of the agitating disc in a—relative to the axis—outer area of a grinding cell. Similar considerations hold for the grinding suspension. In the—relative to the axial direction—central area the flow is redirected and is directed toward the agitating shaft. Two such generally oppositely directed flows in a grinding cell are referred to as braided flows or circular flows. The large openings formed in the agitating discs serve for the passage of grinding material and grinding bodies from a grinding cell to a—viewed in the direction of the overall flow—downstream grinding cell. In the respective opening the grinding bodies are entrained in different directions by the walls that bound the respective opening, so that a completely uncontrolled passage of grinding bodies and grinding material occurs between adjacent grinding cells, thereby strongly affecting the braided flows so that there is a very uneven distribution of grinding bodies in the entire grinding chamber as well as in each individual grinding cell. In addition, a broad distribution for the residence time results for the grinding material during the flow through the grinding chamber.

In the known agitator ball mill grinding material/grinding bodies passage openings are formed in the most downstream agitating disc that forms part of a separator device, for the passage of grinding material and grinding bodies into the separator device. In the most downstream agitating disc, congruent with the already mentioned large openings in the upstream agitating discs grooves are arranged through which the grinding bodies are entrained and are accelerated outwardly through centrifugal forces. The grinding material/grinding bodies passage openings are arranged relatively close to the agitating shaft due to the grooves, that is to say for constructional reasons.

By means of the agitating elements, the grinding bodies are caused to move within the active grinding chamber. The grinding suspension to be processed is supplied with the aid of a suitable pump into the sealed grinding chamber which may be operated under pressure of up to about 5 bars, in special cases up to 10 bars. The solids contained in the grinding suspension, i.e. the grinding material, are exposed to the grinding bodies which are moved relative to each other and are ground or dispersed, depending on their morphology.

Through the entraining forces which are transmitted to the grinding bodies by the grinding material due to its viscosity, the latter ones are transported by the flow toward the grinding material outlet. This causes a non-uniform distribution of the grinding bodies along the axis of the grinding chamber. The non-uniform distribution of the grinding bodies caused by the uncontrolled acceleration of the grinding bodies at the surface of the large openings in the agitating discs adds thereto. For relatively high throughputs and/or relatively high viscosities of the grinding material compression of the grinding bodies with increased wear may very easily be the result. Also, often this may result in overly stressed grinding material and, as a consequence, it may lead to the damaging thereof.

It is therefore an object of the invention to, with the aid of particularly simple means, ensure in an agitator ball mill of the known type a uniform distribution of the grinding bodies along the grinding chamber even at highest throughputs and in a broad operational range, and at the same time yield a particularly uniform grinding effect.

In accordance with the invention, this object is achieved by an agitator ball mill having the features of the horizontally arranged grinding vessel and agitator described herein.

Surprisingly, it has turned out that such an agitator ball mill can be operated with extraordinary high throughputs, if the agitating discs which are otherwise free of through-openings only have small grinding material passage openings arranged in immediate proximity to the agitating shaft. The term "in immediate proximity" is to be understood to comprise cases in which the grinding chamber inner boundary and the radially inner boundary of the grinding material passage openings coincide and thus the grinding material passage openings are bounding the grinding chamber inner boundary, as well as cases in which the radially inner boundary of the grinding material passage openings have an—even small—distance from the grinding chamber inner boundary. For example, the distance of the radially inner boundary of the grinding material passage opening may have a distance from the grinding chamber inner boundary that is in a range of up to one tenth ($\leq 0.1$) of the radial extension of the respective agitating disc from the grinding chamber inner boundary to the radially outer edge of the respective agitating disc. Such small distance of the radial inner boundary of the grinding material passage opening from the grinding chamber inner boundary may be advantageous or even required for reasons of manufacturing. In a very broad range for the throughput, an absolutely constant power consumption is achieved which is an indicator for a uniform distribution of the grinding bodies that is not negatively affected by an increase of the throughput. In addition, over the whole operational range significantly narrower distributions of particles are achieved than are achievable in a single-batch operation with agitator ball mills having agitating discs that have the otherwise conventional large openings in the radially farther outwardly arranged area. Essential for the described effect is that the grinding material passage openings arranged in immediate proximity to the agitating shaft are provided in the agitating discs that are bounding adjacent grinding cells. The grinding bodies are accelerated outwards over the major part of the surface of the agitating disc, so that in the region of the wall of the grinding vessel an increased density of grinding bodies is achieved that forms a correspondingly high flow resistance for the grinding material, i.e. the grinding suspension. Accordingly, there is no bypass, i.e. a free passage, for the grinding material in the outer region of the grinding chamber. This effect is particularly promoted in case the difference of the solid density and the mixture density of the grinding suspension, i.e. of the grinding material consisting of the solids and of the carrier liquid, is as high as possible, preferably equal to or higher than 2 g/cm$^3$. Since the comparatively small grinding material openings are located in an area where there are only few grinding bodies, no uncontrolled exchange of grinding material occurs between adjacent grinding cells, an in particular no significant passages of grinding bodies through the grinding material openings occur.

Particularly advantageous relative radial extensions of the grinding material passage openings of the agitator ball mill according to the invention are described herein.

In principle, only a single grinding material passage opening may be present. An advantageous arrangement of the grinding material passage openings around the agitating shaft of the agitator ball mill according to the invention is described herein.

Particularly advantageous further embodiments of the agitator ball mill according to the invention are described herein, in which different accelerations of the grinding bodies along the radial extension of the agitating discs can be purposefully achieved, whereby a targeted outwardly directed transportation of the grinding bodies is achieved.

In an embodiment of the agitator ball mill according to the invention, the grinding material flows in a guided manner from the circular flow, i.e. the braided flow, in one grinding cell into a similar flow of a downstream grinding cell.

Figure 2:
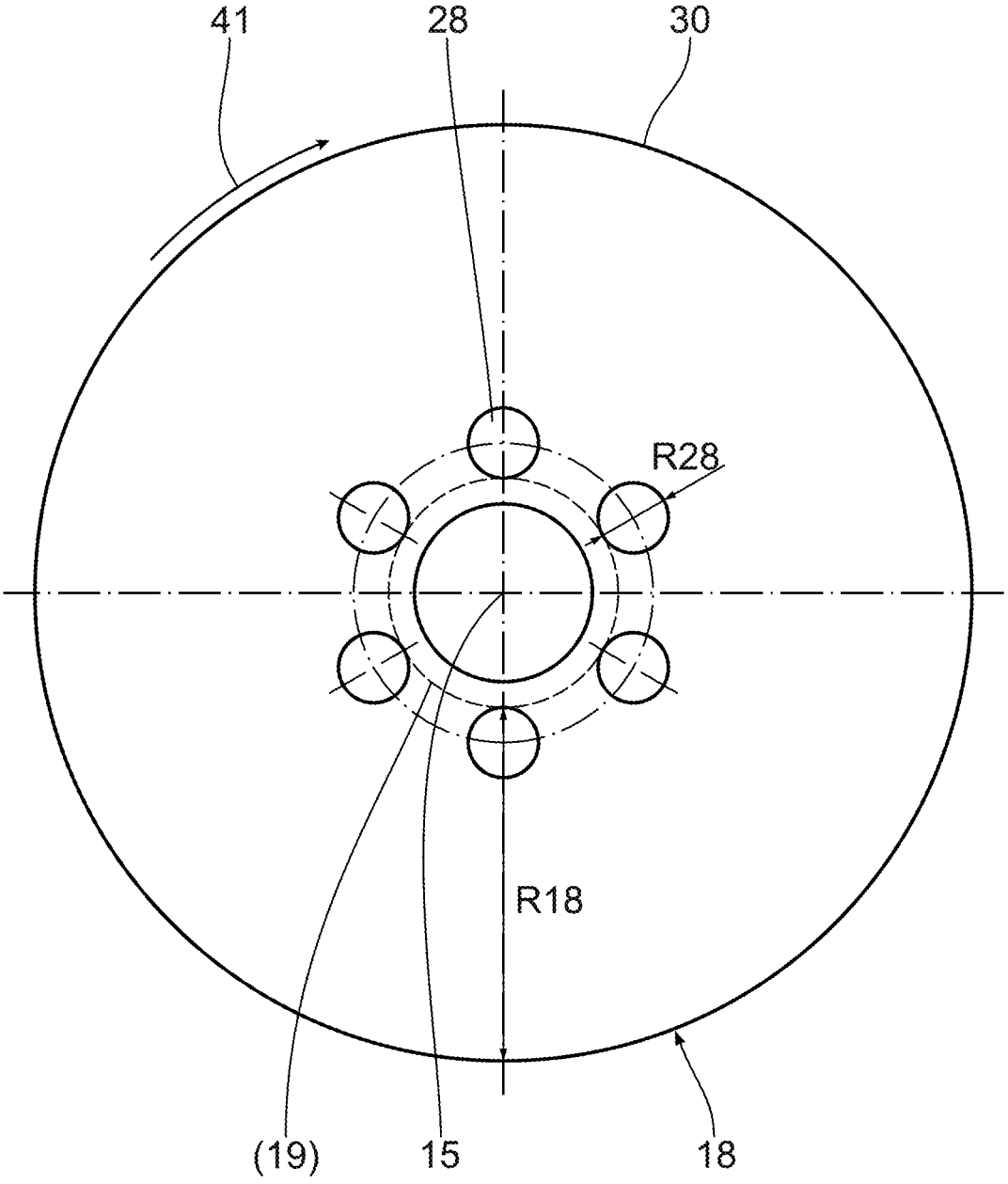
Figure 3:
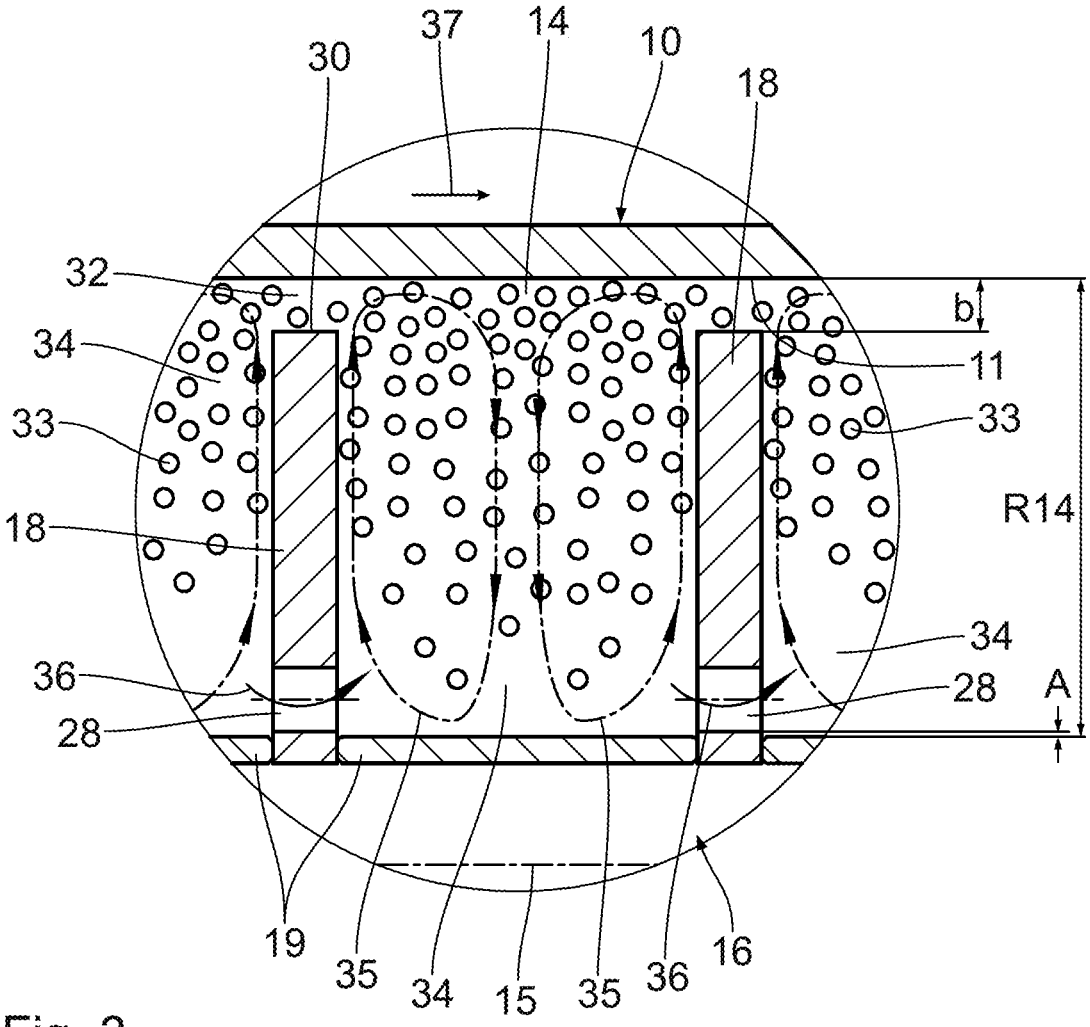
Figure 5:
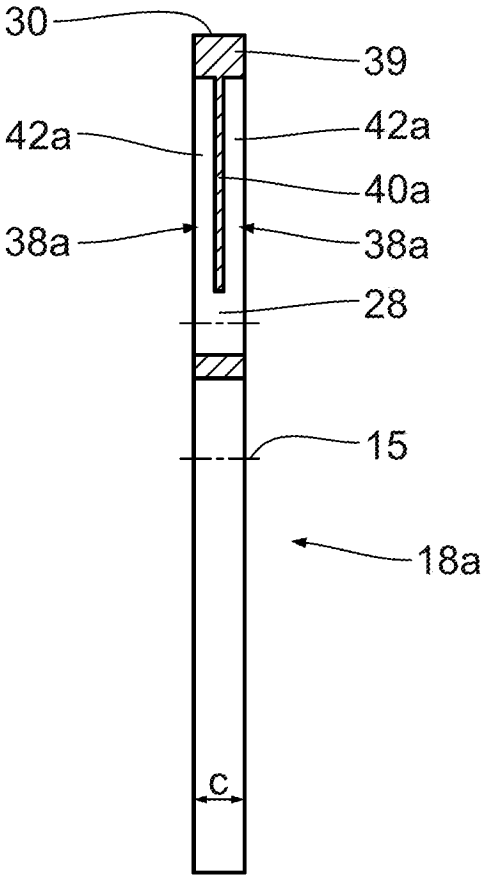
Figure 4:
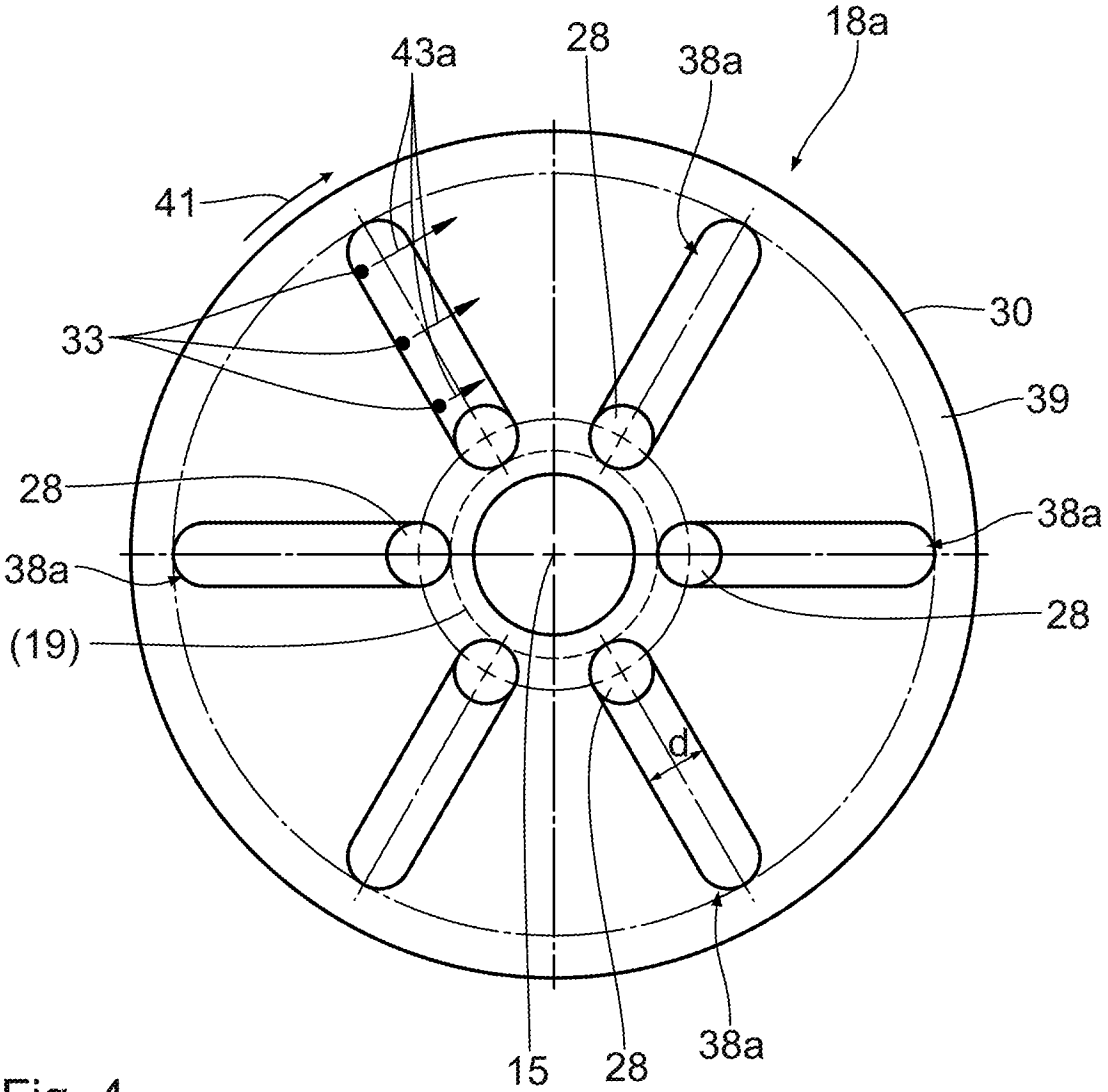
Figure 7:
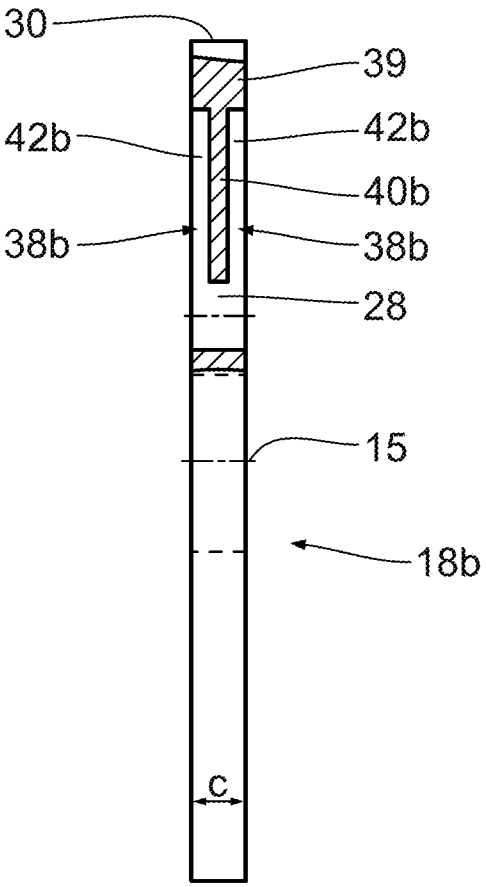
Figure 6:
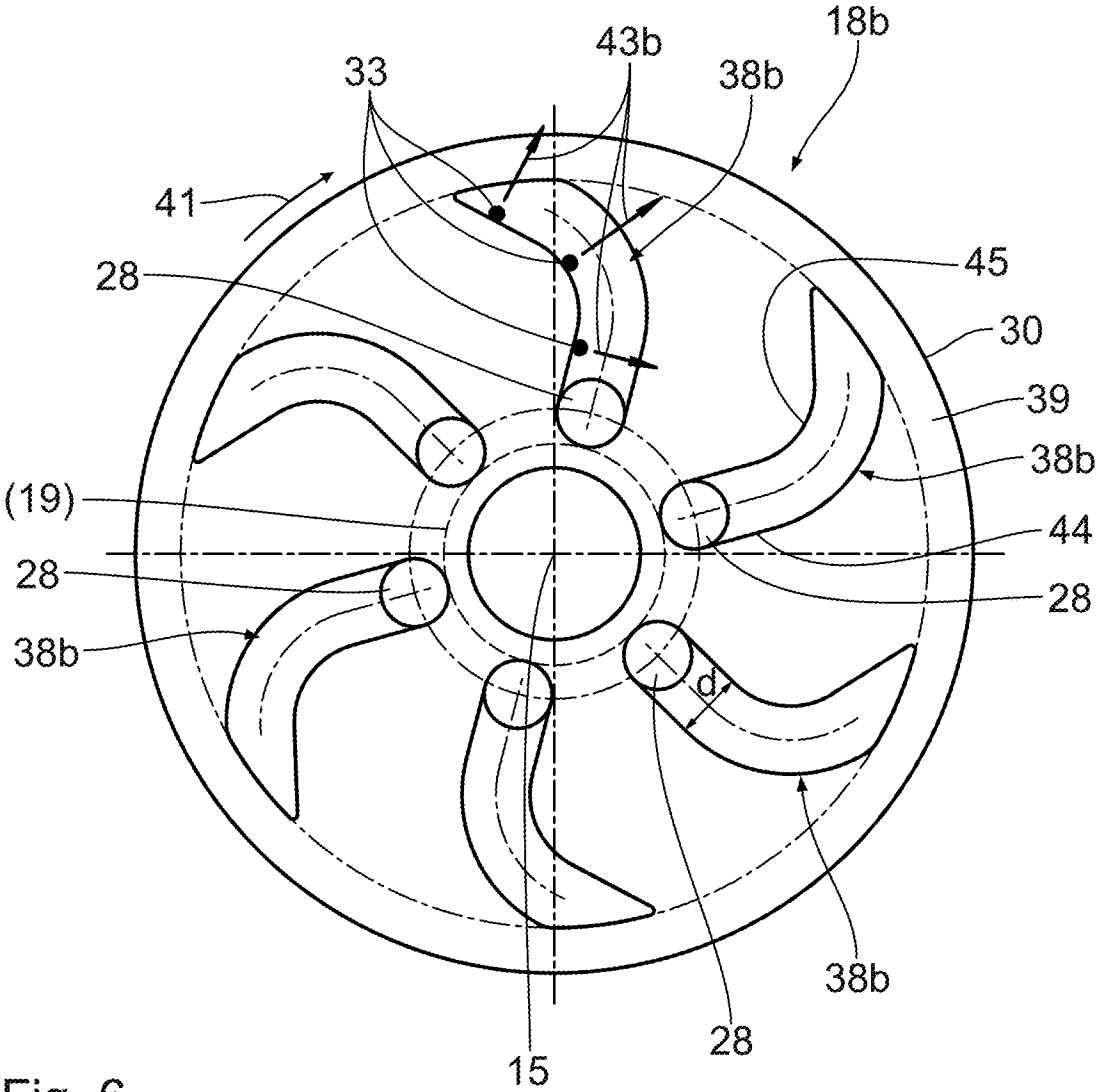
Figure 8:
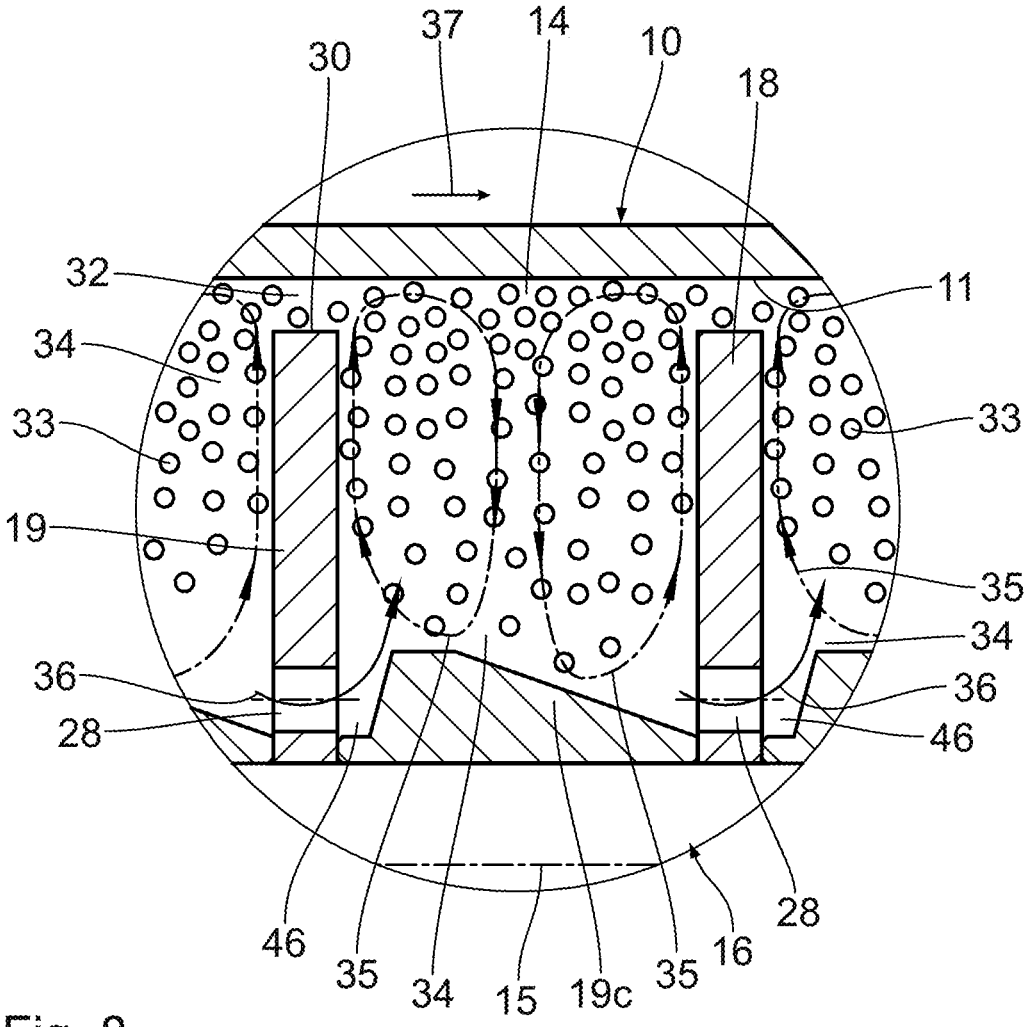

Further advantages and detail of the invention result from further dependent claims and from the following description of embodiments of the invention with the aid of the drawings. These show:

FIG. 1 an embodiment of the agitator ball mill according to the invention in a schematic representation in a side view which is partially cut away, FIG. 2 a top view of a first embodiment of an agitating disc of an agitator ball mill according to the invention, FIG. 3 a detail from FIG. 1 in an enlarged scale relative to FIG. 1, FIG. 4 a top view of a second embodiment of an agitating disc of an agitator ball mill according to the invention, FIG. 5 a partial cross-section through the agitating disc of FIG. 4, FIG. 6 a top view of a third embodiment of an agitating disc of the agitator ball mill according to the invention, FIG. 7 a partial cross-section through the agitating disc of FIG. 6 and FIG. 8 a representation corresponding to FIG. 3 with a modified grinding chamber inner boundary when compared to FIG. 1.

In FIG. 1 a horizontal agitator ball mill is shown. As conventional, it has a stand 1 which is supported against the ground 2. In the stand, there is arranged a drive motor 3 the rotational speed of which may be controlled, and which may comprise a V-belt pulley 4 that may, through V-belt 5 and a further V-belt pulley 6, rotatably drive a drive shaft 7 of the agitator ball mill. The drive shaft 7 is supported in an upper portion 8 of the stand 1 by means of a plurality of bearings 9.

An essentially cylindrical grinding vessel 10 is releasably mounted to the upper portion 8 of the stand 1. The cylindrical grinding vessel 10 has an inner wall 11 and is closed by a first lid 12 at an end facing the upper portion 8 and by a second lid 13 at the opposite end. It encloses a grinding chamber 14. The inner wall 11 thus forms the grinding chamber outer boundary.

An agitating shaft 16 is arranged in the grinding chamber 14 concentric with the common central longitudinal axis 15 of grinding vessel 10 and drive shaft 7, and is connected in a torque-proof manner to the drive shaft 7. The grinding chamber 14 is sealed with the aid of gaskets 17 arranged between the lid 12 and the drive shaft 7. The agitating shaft 16 is supported in the manner of a cantilever, that is to say it is not supported in the region of the second lid 13. Over its entire length it is provided with agitating tools which are embodied as circular agitating discs 18.

The agitating discs 18 are attached to the agitating shaft 16 and are held in a conventional manner on the agitating shaft 16 in a torque-proof manner, for example with the aid of a tongue and groove connection, and are held spaced from one another by means of spacer sleeves 19. The agitating shaft 16 together with the spacer sleeves 19 and the agitating discs 18 form an agitator 20. The spacer sleeves 19 are bounding the essentially cylindrical grinding chamber 14 at its inner end and thus form a grinding chamber inner boundary.

In the region of the first lid 12 a grinding material feed 21 leads in into the grinding chamber 14. At the end of the grinding vessel 10 opposite to the grinding material feed 21 a grinding material outlet 22 leads out of the second lid 12.

At the outer circumference of the last agitating disc 18 adjacent to the second lid 13 a cylindrical cage 23 is formed. It comprises a plurality of openings 24 which are distributed along its circumference. In the separator space 25 which is enclosed by the most downstream agitating disc 18 and the cage 23, there is arranged a screen body 26, which is attached to the second lid 13 and which is connected to grinding material outlet 22. These parts form a grinding material/grinding bodies separating device 27 which is known from EP 2 178 642 A1.

The agitating discs 18 (or 18*a*, 18*b*; see FIG. 4—FIG. 7) comprise one or more grinding material passage openings 28 which are circularly shaped in the embodiment. At their interior end—with respect to the central longitudinal axis 15—the grinding material passage openings 28 are bounding to the spacer sleeves 19, i.e. the grinding chamber inner boundary. The grinding material passage openings 28 are arranged at uniform angular distances from one another, for example six openings 18, as is shown in FIG. 2. Except for the grinding material passage openings 28 the agitating discs 18 (or 18*a*, 18*b*) do not have any openings, they are otherwise completely closed.

The grinding material passage openings 28 comprise a radially outer boundary that has a distance R28 from the spacer sleeve 19 (grinding chamber inner boundary) in the radial direction of the agitating disc 18. For the ratio of the distance R28 of the radially outer boundary of the respective grinding material passage opening 18 from the spacer sleeve 19, i.e. the grinding chamber inner boundary, to the radial outer edge 30 (radially outer boundary) of the agitating discs, the following condition applies: $0.05 \cdot R18 \leq R28 \leq 0.25 \cdot R18$, and more preferably $R28 \leq 0.15 \cdot R18$.

Adjacently arranged agitating discs 18 have the same axial distance a from one another, respectively. In addition, adjacently arranged agitating discs 18 a separator angle $\alpha$ which is defined by a line 29 from the radially outer edge 30 of an agitating disc 18 and the inner end of the adjacent agitating disc 18 at the agitating shaft 16, i.e. at the respective spacer sleeve 19, as well as by a line 31 running parallel to the central longitudinal axis 15. Here the condition $30° \leq \alpha \leq 60°$ applies.

The width b of the gap 32 between the radial outer edge 30 and the wall 11 amounts at maximum 20% of the free radius R14 of the grinding chamber 14.

The grinding chamber 14 is essentially filled with grinding bodies 33, and preferably with grinding bodies 33 made of materials having a high density, for example high performance ceramics made of $ZrO_2$ (zirconium dioxide) having a solid density of 6.0 g/cm$^3$. The degree of filling (bulk volume of the grinding bodies relative to the volume of the grinding chamber) is in the range of 50% to 90%, in particular in the range of 80% to 90%. The high solid density of the grinding bodies 33 relative to the density of the grinding suspension is important for the desired effects, i.e. to transport the grinding bodies 33 near the surfaces of the respective agitating discs 18 outwards into the zone of the accumulated grinding bodies.

Between adjacent agitating discs 18 grinding cells 34 are formed, respectively, in which the braided flows 35 shown in FIG. 3 are forming as the agitating shaft 16 is driven. As can be seen from the drawing, grinding bodies 33 and grinding material to be processed, e.g. the grinding suspension, flow outwards in the region of an agitating disc 18 as a consequence of the tangential acceleration caused by the agitating disc, and flow back inwards toward the agitating shaft 16 in the axially central region of the grinding cell 34. In the region of the grinding shaft 16 the concentration of the grinding bodies is minimal. In this region, grinding material flows from one grinding cell 34 through the grinding material passage openings 28 into an adjacent grinding cell 34. The flow of grinding material through the grinding material passage openings 28 is indicated through flow direction arrows 36 in FIG. 3. The overall direction of flow 37 through the agitator ball mill in FIGS. 1 and 3 is from left to right, that is to say from the grinding material feed 21 to the grinding material outlet 22. In FIG. 3, however, the grinding material passage openings 28 are not bounding the spacer sleeve 19, but rather the radially inner boundary of the respective grinding material passage opening 28 has a small distance A from the spacer sleeve 19 in radial direction which may be up to one tenth (≤0.1) of the radial extension R18 of the agitating disc 18, measured from the spacer sleeve 19 (grinding chamber inner boundary) to the outer edge 30 (radially outer boundary), so that generally the condition 0≤A≤R18 applies (in case the distance is 0 the radially inner boundary of the respective grinding material passage opening 28 is bounding the spacer sleeve 19, see FIG. 2).

The acceleration of the grinding bodies 33 caused by the agitating discs 18 can be increased by means of groove-like channels 38*a*, 38*b* (see FIG. 4-FIG. 7), which are formed in the agitating discs 18 and which start at a grinding material passage opening, respectively, and are directed to the radial outer edge 30 of the respective agitating disc 18 (or 18*a*, 18*b*), however, without penetrating the radial outer edge 30 of the respective agitating disc 18 (or 18*a*, 18*b*). Accordingly, an agitating disc outer ring 39 remains which, in the embodiment shown, has the thickness c of the agitating disc 18 (or 18*a*, 18*b*). In addition, the agitating discs 18 (or 18*a*, 18*b*) are not penetrated in a direction parallel to the central longitudinal axis 15. Accordingly, the respective agitating disc 18 (or 18*a*, 18*b*) is completely closed and has only the already described grinding material passage openings 28.

According to a first embodiment shown in FIGS. 4 and 5, the channels 38*a* are running radially relative to the central longitudinal axis 15 and have a width d that corresponds to the diameter of the grinding material passage openings 28. The respective channels 38*a* are formed on both sides of the respective agitating disc 18*a* so that—as can be seen in FIG. 5—a thin wall portion 40*a* remains between them. As can be seen again from FIG. 4, the grinding bodies 33 are tangentially entrained by the respective trailing channel wall 42*a*, viewed in the spinning direction 41, and are thus accelerated by centrifugal forces (centrifuged). The tangential speeds and the radially directed tangential accelerations resulting therefrom increase radially outwards, as this is indicated by the radially outwardly increasing length of the arrows 43*a* representing the speed.

In the embodiment of the agitating discs 18*b* shown in FIGS. 6 and 7, the channels 38*b*-having a width d (corresponding to the diameter of the grinding material passage openings 28) and being separated by a wall portion 40*b*—comprise an inner straight channel portion 44 starting from the respective grinding material passage opening 28 which is followed radially outwardly by an outer channel portion 45, which is bent off counter to the spinning direction 41 of the agitating disc 18*b* and which ends ahead of the outer ring 39. Due to this design, the grinding bodies 33 are experiencing accelerations in different directions. In the inner channel section 44 the entraining of the grinding bodies 33 by the channel wall 42*b* is tangential, whereas in the radially outer channel portion 45 it is both radial and tangential due to the direction of the channel wall 42*b*. Also here, the different lengths of the arrows 43*b* representing the speed symbolize the different directions and the different amounts of the accelerations exerted on the grinding bodies 33. It is noteworthy, that the channel 38*b* ends at the outer ring 39 having its full width. The trailing channel wall 42*b* thus exerts accelerations which are outwardly directed only all the way to the very outer end. The grinding bodies 33 which are engaged by the channel 38*b* are thus quasi positively pushed outwards.

FIG. 8 shows a further improvement which can be applied to all of the afore-described embodiments, in which—relative to the overall direction of flow 37—a redirection channel 46 is formed between a spacer sleeve 19 and the grinding material passage opening 28 of an upstream agitating disc 18, this redirection channel radially redirecting the grinding material flow from a—relative to the overall direction of flow 37—upstream grinding cell 34 and merging it into the radially outwardly directed braided flow 35 in the downstream grinding cell 34. The spacer sleeve 19*b* is embodied such that the—in the overall direction of flow 37—downstream grinding material passage opening 28 can be unimpededly reached by the grinding material flow in the grinding cell 34.

The invention claimed is:

1. Agitator ball mill having a horizontally arranged grinding vessel which encloses a cylindrical grinding chamber bounded by a wall of the grinding vessel and by a grinding chamber inner boundary, with a grinding material feed leading into the cylindrical grinding chamber at one end, and with a grinding material outlet leading out of the cylindrical grinding chamber at the other end, having a grinding material/grinding bodies separating device arranged upstream thereof, having an agitator arranged in the cylindrical grinding chamber, that has an agitating shaft having a central longitudinal axis and agitating discs mounted to the agitating shaft in a torque-proof manner and spaced from one another by a distance, wherein two adjacently arranged agitating discs of the agitating discs mounted to the agitating shaft are bounding a grinding cell, respectively, wherein each of the agitating discs mounted to the agitating shaft comprises openings connecting the adjacent grinding cells, and wherein—with respect to the central longitudinal axis—the agitating discs have a radial extension R18 from the grinding chamber inner boundary to a radially outer edge of the agitating discs, wherein the openings are embodied as grinding material passage openings and are arranged only in the immediate proximity of the grinding chamber inner boundary, wherein the grinding material passage openings have a radially outer boundary, respectively, that has a distance R28 from the grinding chamber inner boundary in a radial direction of the agitating disc, wherein for a ratio of the distance R28 of the radially outer boundary of the grinding material passage openings to the radial extension R18 of the agitating discs the following condition applies: $0.05 \cdot R18 \leq R28 \leq 0.25 \cdot R18$, and wherein the agitating discs are otherwise closed.

2. Agitator ball mill according to claim 1, wherein further for the ratio of the distance R28 of the radially outer boundary of the grinding material passage openings to the radial extension R18 of the agitating discs the following condition applies: $R28 \leq 0.20 \cdot R18$.

3. Agitator ball mill according to claim 1, wherein further for the ratio of the distance R28 of the radially outer boundary of the grinding material passage openings to the radial extension R18 of the agitating discs the following condition applies: $R28 \leq 0.15 \cdot R18$.

4. Agitator ball mill according to claim 1, wherein the grinding material passage openings are arranged at uniform angular distances from one another.

5. Agitator ball mill according to claim 1, wherein on both sides of the agitating discs channels are formed in the agitating discs, wherein the channels start at the grinding material passage openings and do not penetrate through the respective agitating disc in a direction of the central longitudinal axis of the respective agitating disc, and wherein the channels are directed toward the radially outer boundary of the respective agitating disc and are closed toward the radially outer boundary of the respective agitating disc.

6. Agitator ball mill according to claim 5, wherein the channels formed in the agitating discs on different sides of the agitating discs and starting at a said grinding material passage opening are pairwise congruently arranged.

7. Agitator ball mill according to claim 5, wherein the channels formed in the agitating discs on both sides of the agitating discs are running straight and radially with respect to the central longitudinal axis.

8. Agitator ball mill according to claim 5, wherein the channels formed in the agitating discs on both sides of the agitating discs comprise an outer channel portion which is bent off counter to a spinning direction of the agitating discs.

9. Agitator ball mill according to claim 5, wherein the agitating discs comprise an agitating disc outer ring which is arranged radially outwardly.

10. Agitator ball mill according to claim 1, wherein downstream of the grinding material passage opening that connects an upstream grinding cell of the adjacent grinding cells with a downstream grinding cell of the adjacent grinding cells when viewed in an overall direction of flow of the agitator ball mill, a redirecting channel is provided that radially opens out into the downstream grinding cell.

11. Agitator ball mill according to claim 1, wherein a gap is formed between the radially outer edge of the agitating discs and the wall of the grinding vessel, respectively, a radial width of which amounts at maximum 20% of a free radius R14 of the cylindrical grinding chamber between the cylindrical grinding chamber inner boundary and the wall of the grinding vessel.

12. Agitator ball mill according to claim 1, wherein the cylindrical grinding chamber contains a bulk volume of the grinding bodies, wherein the bulk volume of the grinding bodies corresponds to 50% to 90% of a volume of the cylindrical grinding chamber.

13. Agitator ball mill according to claim 12, wherein the cylindrical grinding chamber further contains as the grinding material a grinding suspension comprising solids and a carrier liquid, the grinding suspension having a mixture density, and wherein the grinding bodies of the bulk volume have a solid density which is higher by at least 2 $g/cm^3$ than the mixture density of the grinding suspension.

14. Agitator ball mill according to claim 1, wherein the cylindrical grinding chamber contains a bulk volume of the grinding bodies, wherein the bulk volume of the grinding bodies corresponds to 80% to 90% of a volume of the cylindrical grinding chamber.

* * * * *